United States Patent [19]

Monroe

[11] 4,076,245

[45] Feb. 28, 1978

[54] RACING GAME AND GAME PIECE

[76] Inventor: Benjamin F. Monroe, 1065 E. Flamingo Road, Apartment 506, Las Vegas, Nev. 89109

[21] Appl. No.: 712,014

[22] Filed: Aug. 5, 1976

[51] Int. Cl.[2] ..... A63F 9/14

[52] U.S. Cl. ..... 273/86 C; 46/202

[58] Field of Search ..... 273/86 C; 272/35; 46/202, 206, 251

[56] References Cited

U.S. PATENT DOCUMENTS

| | | | |
|---|---|---|---|
| 1,589,286 | 6/1926 | Zabel | 273/86 C UX |
| 1,661,865 | 3/1928 | Zabel | 273/86 C UX |
| 2,517,324 | 8/1950 | Kurose | 273/86 C |
| 2,767,986 | 10/1956 | Newberry | 273/86 C |

*Primary Examiner*—Anton O. Oechsle

*Attorney, Agent, or Firm*—Fulwider, Patton, Rieber, Lee & Utecht

[57] ABSTRACT

A game in which a plurality of game pieces are moved about a smooth endless track in a random manner by tilting the track cyclicly to provide a downhill racing surface in advance of the game pieces. The track is oval in shape and is tilted or wobbled by means of a pair of eccentric cams which cyclicly raise and lower weight-supporting arms at one end of the track, to tilt it about a centrally located pivot point. Each game piece includes a base portion having a substantially flat bottom with a number of ball bearings mounted therein to facilitate random movement of the game pieces along the track, and to enhance the random nature of the movement of the game pieces with respect to the track and with respect to each other.

8 Claims, 10 Drawing Figures

RACING GAME AND GAME PIECE

BACKGROUND OF THE INVENTION

This invention relates generally to table-top racing games and, more particularly, to such games in which a plurality of game pieces are raced about an endless track by tilting the track to provide a downhill surface in advance of the game pieces.

Games of this general type are used either as an amusement for children or adults, or, in areas in which gambling is legalized, as a gambling game. Although games of this general type can be found in the prior art, all suffer from a number of significant shortcomings. For example, in some of the prior art devices, each game piece runs in its own predetermined track, and an element of randomness is lost since the mechanism of the game might favor one track or another. Other games of the prior art employ substantially circular tracks which are wobbled about a central axis to provide the necessary impetus to the game pieces. The circular track has the disadvantage of being less interesting to the participants in the game, and less like the oval tracks used in horse racing, automobile racing, and athletic events. One game to be found in the prior art utilizes an oval track, but the track is tilted about only a single axis, and is permanently sloped in opposite directions at its curved end portions, to propel the game pieces around these portions.

The game pieces used in prior art games of this general type are usually miniature wheeled vehicles, wheeled toy horses, or the like. Spherical balls can be used as the game pieces, but these have the disadvantage that they cannot be identified, except by color, as they roll around the track.

Ideally, a game of this type should have characteristics which render it as much as possible like a real racing event. For example, the game pieces should not be confined to predefined tracks, the game track should be oval and should be essentially coplanar, although it may be banked, and the game pieces should be free to move in a relatively random manner with respect to the track and with respect to each other, but should be readily identifiable by appropriate markings. The present invention, as will now be described, has all of these advantageous characteristics.

SUMMARY OF THE INVENTION

The present invention resides in a racing game of the foregoing general type, in which the structure of the track, the means for tilting or wobbling it in a rotary fashion, and the specific design of the game pieces, all combine to produce a random and interesting movement of the game pieces about the track. Briefly, and in general terms, the game comprises a platform having an endless track formed thereon, a supporting frame, mounting means for mounting the platform on the frame to permit the platform to be tilted or pivoted in any direction from the horizontal, and tilting means operative to tilt the platform and track in a rotary fashion. The tilting means supports the platform at two support points by a pair of weight-supporting arms, and includes means for raising and lowering the arms in a cyclic manner, to tilt the platform so that the lowest point of the track advances cyclicly about the track periphery. The game also utilizes a plurality of game pieces, each of which has a substantially flat bottom with a plurality of ball bearings mounted therein. As the platform and the track are tilted as described, the game pieces move in a random manner with respect to the track and with respect to each other. In particular, the game pieces have no particular front-to-rear orientation, and are free to move in any direction, as well as to rotate about an axis perpendicular to the track surface, as they interact with each other and with the track.

In the presently preferred embodiment of the invention, the track is generally oval in shape, and is banked more steeply at its curved end portions, to provide the necessary centripetal forces to accelerate the game pieces around the curves. An inner lip and an outer lip are provided to ensure that the game pieces remain on the track.

More specifically, the tilting means of the present invention includes a pair of pivoted lift arms which support the platform at two points located at the same end and at opposite sides of the track. The tilting means also includes a pair of eccentric cams which are rotated at a controllable speed, and which engage two corresponding cam followers mounted on the lift arms, to raise and lower the lift arms in a cyclic manner. The eccentric cams are angularly displaced from each other by 90°, so that the reciprocating motion of the lift arms is also phase-displaced by 90°. As a result, the platform is tilted in a rotary manner so that the lowest point in the track progressively advances around its periphery.

It will be appreciated from the foregoing that the present invention represents a significant advance in racing games of this type. In particular, the game of the present invention utilizes game pieces which can move in an interesting random fashion, this randomness being further enhanced by the oval shape of the track and the tilting means utilized to operate it. Other aspects and advantages of the invention will become apparent from the following more detailed description, taken in conjunction with the accompanying drawings.

DETAILED DESCRIPTION

Figure 1:
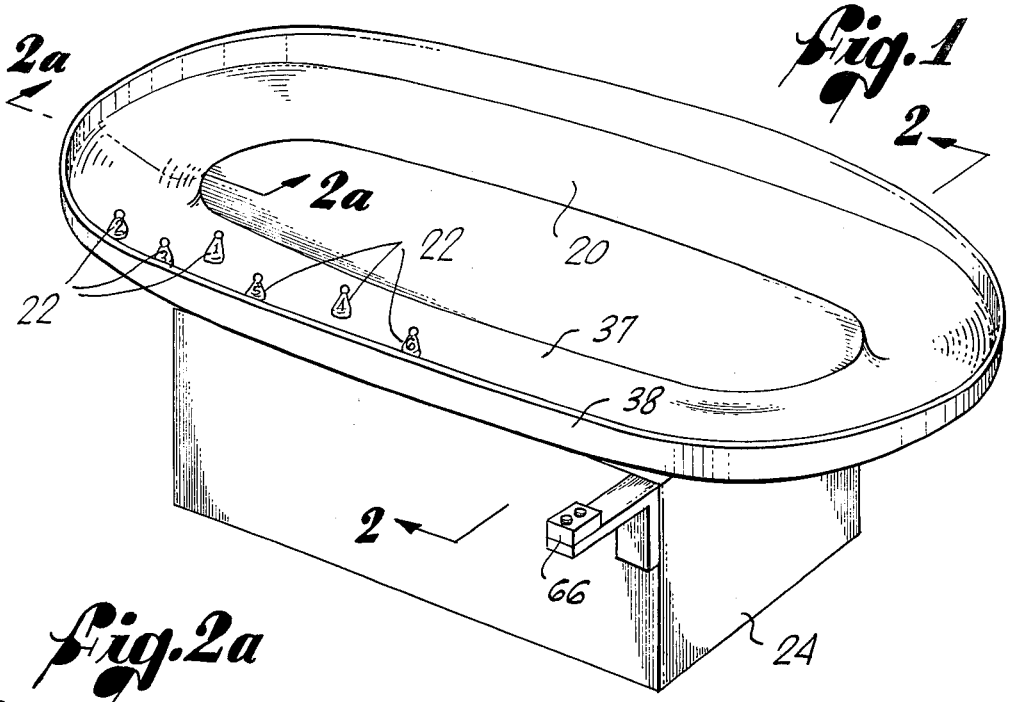
FIG. 1 is a perspective view of a racing game apparatus embodying the features of the present invention.

As shown in the drawings for purposes of illustration, the present invention is principally concerned with a racing game of which the principal components are a continuous track, indicated by reference numeral 20, and a plurality of game pieces 22 which are made to move about the track by gravitational forces only. The track 20 is relatively wide compared with the size of the game pieces 22, and, in the illustrative embodiment, is oval in shape, having two relatively straight portions, and two curved end portions. The track 20 is mounted on a supporting frame 24 and is moved with respect to the frame in such a manner as to propel the game pieces 22 about the track, by always maintaining a downhill track surface in advance of the moving pieces.

In accordance with the present invention, the game pieces 22 are moved in a relatively random fashion about the surface of the track 20, largely as a result of the novel design of the game pieces themselves, and also as a result of a novel means by which the track is tilted in such a manner as to move its lowest point progressively around the track periphery. As will be described, the track 20 is pivoted about an approximately central location by raising and lowering two support points at one end of the track in a cyclic and phase-displaced manner.

Figure 7:
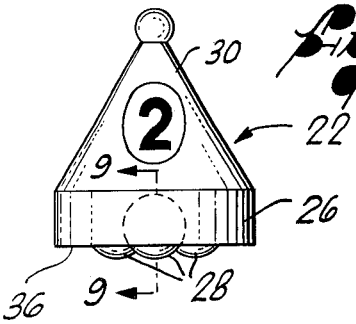
FIG. 7 is a side elevational view of one of the game pieces of the invention.
Figure 8:
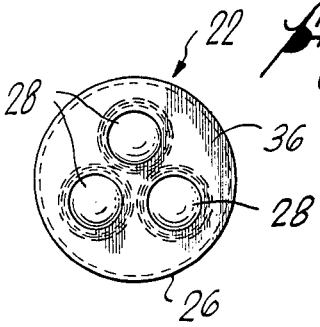
FIG. 8 is a bottom plan view of the game piece of FIG. 7.
Figure 9:
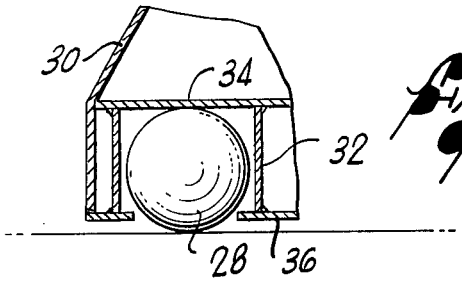
FIG. 9 is an enlarged fragmentary view, partly in section, taken substantially along the line 9—9 in FIG. 7.

As shown in FIGS. 7–9, each of the game pieces 22 includes a base portion 26 with a flat bottom in which are mounted three ball bearings 28 in a symmetrical arrangement. Each game piece 22 also includes an upper portion 30, which may be conical in shape, as illustrated, although the shape is not, of course, critical to the invention. Each ball bearing 28 is retained in a vertically oriented tube 32 and bears on an upper wall 34 of the base portion 26. The base portion 26 also has a lower wall 36 which is spaced from the upper wall 34 by a distance slightly less than the diameter of the balls 28, so that the latter protrude slightly from the lower wall.

It will be apparent that each of the game pieces 22 is free to move in any direction on the surface of the track 20, and is also free to rotate about a central axis, further enhancing the randomness of motion of the game pieces. The non-circular shape of the track 20 adds a further element of randomness to the game, since the game pieces 22 will move around the curved end portions in a substantially different fashion from the way that they negotiate the straight portions of the track. The novel features of the means by which the track 20 is tilted to effect movement of the game pieces around it will now be described in detail.

Figure 2A:
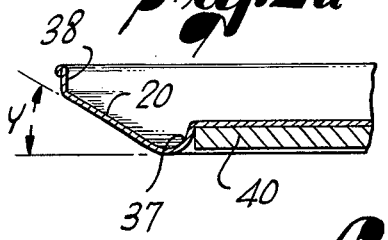
FIG. 2*a* is a sectional view of an end portion of the game track, taken substantially along the line 2*a*—2*a* in FIG. 1.
Figure 2:
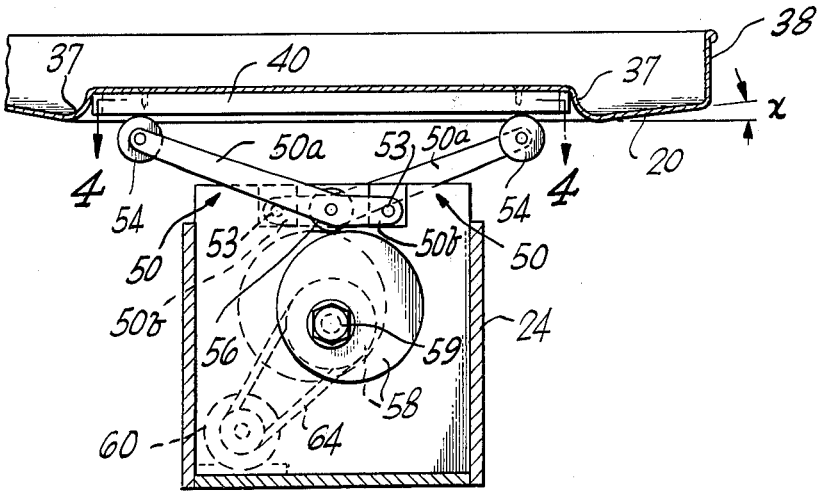
FIG. 2 is a sectional view of the game apparatus taken substantially along the line 2—2 in FIG. 1.
Figure 4:
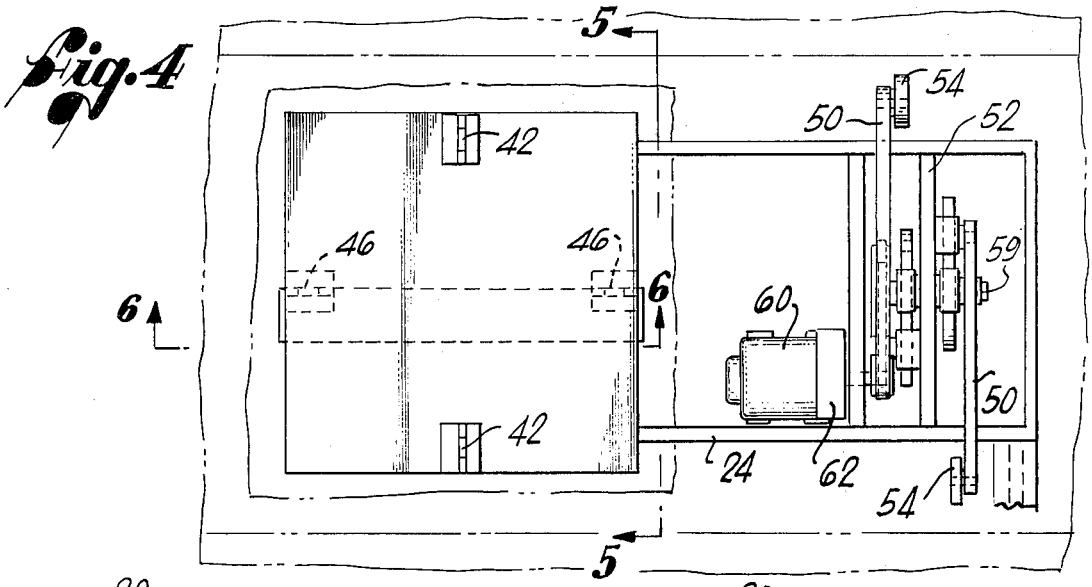
FIG. 4 is a fragmentary plan view of the game apparatus taken substantially along the line 4—4 in FIG. 2.
Figure 5:
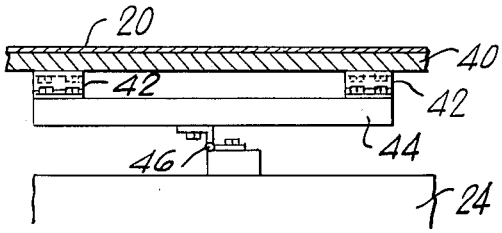
FIG. 5 is a fragmentary sectional view taken substantially along the line 5—5 in FIG. 4.
Figure 6:
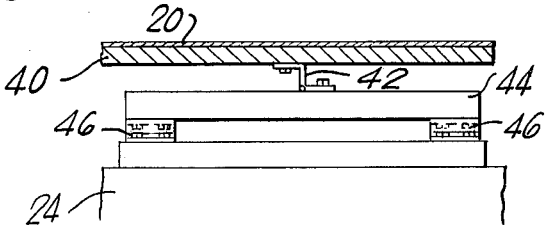
FIG. 6 is a fragmentary sectional view taken substantially along the line 6—6 in FIG. 4.

As best shown in FIG. 2, the track 20 is formed as a continuous sheet which also covers the area within the inner boundary of the track. The track 20 is banked more steeply at its curved end portions than at its straight side portions, and is bounded on the inside by a curved lip 37, and on the outside by an outer lip 38 taking the form of a substantially vertical wall. The sheet from which the track 20 is formed is mounted on a flat platform 40 which, as shown in FIGS. 4–6, is hinged by a pair of aligned hinges 42 to an intermediate panel 44 positioned below the platform 40. The intermediate panel 44 is, in turn, hinged by a second pair of hinges 46 to a portion of the supporting frame 24, the second pair of hinges 46 being disposed approximately at right angles to the first pair. It will be apparent that the hinges 44 and 46 allow movement of the platform 40 and track 20 in either or both of the two axes of the pairs of hinges, resulting in a pivotal support located approximately at the center of the track.

Figure 3:
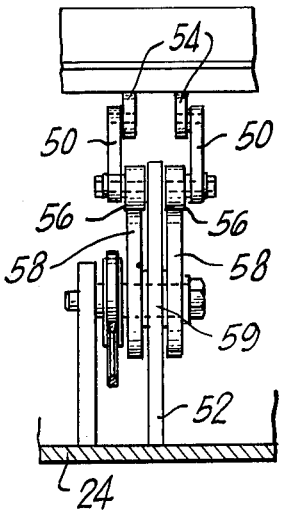
FIG. 3 is a side elevational view of the cam and driving mechanism shown in FIG. 2.

The track 20 and platform 40 are tilted from one end thereof by means of the tilting mechanism shown in FIGS. 2–4. This mechanism includes a pair of lift arms 50 each pivoted to a vertically extending support member 52 of the supporting frame 24, for pivotal motion in a vertical plane. As best shown in FIG. 2, each lift arm 50 is a bent arm having an upper long portion **50*a*, the remote end of which supports a contact roller 54, and a short lower portion 50*b*, the remote end of which is pivotally connected, as shown at 53, to the support member 52 of the frame 24. At the elbow of each lift arm 50, i.e., between the long portion 50*a* and the short portion 50*b*, there is rotatably mounted a cam follower 56, and these engage respective eccentric cams 58 which are mounted for rotation together on a shaft 59 journaled in the support member 52 of the frame 24. The eccentric cams 58 are mounted for rotation in vertical planes, and are driven by an electric motor 60, through appropriate gearing 62, and a belt drive 64. The speed of operation of the track can be controlled by motor controls, indicated at 66**.

The weight of the platform 40 and track 20 is supported in part by the contact rollers 54, and is transmitted through the lift arms 50, cam followers 56 and cams 58 to the support frame 24. The eccentric cams 58 are mounted in such a manner that their points of maximum eccentricity are angularly separated by 90°. Thus, as the cams 58 are rotated, the contact rollers 54 will be raised and lowered in a cyclic fashion, with a 90° phase displacement between the two motions.

The lift arms 50 are mounted such that the level of the platform 40 when fully raised by one of the arms 50 is substantially above the level of the hinges 42 and 46, and the level of the platform when fully lowered by one of the arms 50 is substantially lower than these hinges. Therefore, when the platform 40 is raised at the end by which it is supported by the lift arms 50, the opposite end is lowered with respect to the hinges 42 and 46. The overall effect of the motions of the lift arms 50 is that the lowest point of the platform 40 and of the track 20 will move progressively around the track periphery, and the game pieces 22 will be thereby propelled around the track.

The angle at which the track 20 is banked relative to the platform 40 will, of course, depend on the particular size and shape selected for the track, as well as upon other factors, such as the speed of operation of the motor 60 which drives the mechanism for tilting the track. In the embodiment illustrated, the bank angle of the track varies from only a few degrees on the straight portions, as indicated at 'X' in FIG. 2, to a maximum of approximately 30° at the curved ends of the track, as indicated at 'Y' in FIG. **2*a***.

It will be appreciated from the foregoing that the present invention represents a significant advance in racing games of this general type. In particular, the game of the invention utilizes game pieces which can move and rotate in a random fashion with respect to each other and with respect to the track, and employs a novel track tilting mechanism, which, in combination with the game pieces, results in an interesting and random movement of the game pieces around the track. Although a specific embodiment of the invention has been described in detail for purposes of illustration, it will be appreciated that various modifications may be made without departing from the spirit and scope of the invention. Accordingly, the invention is not to be limited except as by the appended claims.

I claim:

1. A racing game comprising:

a platform having an endless track formed thereon;

a supporting frame;

mounting means for mounting said platform on said frame to permit said platform to be tilted in any direction with respect to said frame;

tilting means operative to support said platform at two support points, and including a pair of weight-supporting arms and means for raising and lowering said arms cyclicly, to tilt said platform in such a manner that the lowest point of said track progresses around the track; and a plurality of game pieces movable by gravitational forces along said track;

whereby said game pieces are moved by gravitational forces around said track in a random manner with respect to said track and with respect to each other.

2. A racing game as set forth in claim 1, wherein said track is oval in shape, having substantially straight sides and substantially semi-circular ends, and said track is banked at its ends to provide the necessary centripetal forces to said game pieces.

3. A racing game as set forth in claim 1, wherein:

said weight-supporting arms are pivotally mounted to said supporting frame; and said means for raising and lowering said arms includes a pair of cams mounted for rotation together about a common axis below said weight-supporting arms, a pair of cam followers mounted intermediate the ends of said weight-supporting arms, and drive means coupled to rotate said cams and thereby raise and lower said weight-supporting arms, said cams being mounted such that the angular positions of their maximum radii are displaced from each other by approximately 90°.

4. A racing game as set forth in claim 1, wherein said mounting means includes:

an intermediate panel disposed between said platform and said supporting frame;

first hinge means connecting said intermediate panel with said platform for pivotal movement about a first axis; and second hinge means connecting said intermediate panel with said supporting frame for pivotal movement about a second axis substantially at right angles to said first axis, whereby said first and second hinge means combine to allow pivotal movement of said platform with respect to said supporting frame.

5. A racing game as set forth in claim 1, wherein each of said plurality of game pieces has a base with a substantially flat bottom and a plurality of ball bearings mounted in said base to facilitate movement along said track.

6. For use in a racing game wherein a plurality of game pieces are propelled by gravitational forces around an endless racing surface, the combination comprising:

a platform having an endless track formed thereon to provide the racing surface;

a supporting frame;

mounting means for mounting said platform on said frame to permit said platform to be tilted in any direction with respect to a horizontal plane;

tilting means supporting said platform at two supporting points and including a pair of weight-supporting arms pivotally mounted to said supporting frame, a pair of cams mounted for rotation together on a common axis, and disposed in substantially vertical planes beneath corresponding ones of said weight supporting arms, a pair of cam followers mounted for rotation on said weight-supporting arms intermediate the ends of said arms, and drive means coupled to rotate said cams and thereby to raise and lower said weight-supporting arms cyclically;

whereby said platform is tilted in a cyclic fashion, with the lowest point of said track progressing around the track periphery, to provide a downhill racing surface for the game pieces.

7. A combination as set forth in claim 6, wherein said track is oval in shape, having two substantially straight sides, and two curved semi-circular ends.

8. A combination as set forth in claim 7, wherein said track is banked to a maximum angle at said ends of said track to provide the centripetal forces necessary to accelerate the game pieces around said end portions of said track.

* * * * *